US005543081A

United States Patent [19]

Ishida et al.

[11] Patent Number: 5,543,081

[45] Date of Patent: Aug. 6, 1996

[54] LUBRICANT ADDITIVE

[75] Inventors: Noboru Ishida; Mitsuaki Ishimaru; Mineo Kagaya, all of Yokohama, Japan

[73] Assignee: Nippon Oil Co., Ltd., Japan

[21] Appl. No.: 962,305

[22] Filed: Oct. 16, 1992

[30] Foreign Application Priority Data

Oct. 18, 1991 [JP] Japan ..... 3-298014

[51] Int. Cl.[6] ..... C10M 139/00

[52] U.S. Cl. ..... 508/194; 208/18; 208/19

[58] Field of Search ..... 252/49.6, 51.5 A; 208/18, 19

[56] References Cited

U.S. PATENT DOCUMENTS

| | | | |
|---|---|---|---|
| 3,000,916 | 9/1961 | Klass et al. | 252/49.6 |
| 3,405,064 | 10/1968 | Miller | 252/51.5 A |
| 4,328,113 | 5/1982 | Horodysky et al. | 252/49.6 |
| 4,524,004 | 6/1985 | Horodysky et al. | 252/49.6 |
| 4,524,005 | 6/1985 | Horodysky et al. | 252/49.6 |
| 4,529,529 | 7/1985 | Horodysky | 252/49.6 |
| 4,705,643 | 11/1987 | Nemo | 252/51.5 A |
| 4,713,190 | 12/1987 | Erdman | 252/49.6 |

FOREIGN PATENT DOCUMENTS 14-0003115 3/1939 Japan .

*Primary Examiner*—Margaret Medley
*Attorney, Agent, or Firm*—Adams & Wilks

[57] ABSTRACT

A method of making a novel lubricant additive comprising a boric acid modified aminoamide compound is disclosed. A lubricating oil composition incorporating the modified aminoamide compound is also disclosed, which exhibits enhanced high-temperature cleanliness when used particularly for two stroke cycle engines.

10 Claims, No Drawings

LUBRICANT ADDITIVE

BACKGROUND OF THE INVENTION

1. Field of the Invention

This invention relates to a method of preparing a boric acid modified aminoamide compound and a lubricating oil composition containing the same.

2. Prior Art

Aminoamide compounds have been found useful as a dispersant for engine oil, particularly two stroke cycle engine oil. It is well known that about 9–20 weight percent of aminoamide dispersants are formulated in an engine oil typically conforming to outboard two stroke cycle engine oil specification, namely, NMMA TC-W or TC-WII. However, due to their lack of thermal stability, the conventional aminoamide dispersants were often found incapable of detergency performance and preventing piston ring sticking when exposed to elevated temperature in an outboard high-output engine or an air-cooled two stroke cycle motorcycle engine. A growing demand has therefore arisen for such aminoamide dispersants which retain their intrinsic low-temperature detergency performance and yet demonstrate enhanced detergency capabilities at high temperature.

It is also known to modify dispersants such as succinimide by modifying with boric acid thereby improving high-temperature performance, but with no significant results. No reports however have heretofore been made on the treatment of aminoamide dispersants with boric acid.

SUMMARY OF THE INVENTION

With the foregoing difficulties of the prior art in view, the present invention seeks to provide a method of making a boric acid modified aminoamide compound which can afford an oil having high thermal stability and good cleanliness at high temperature.

The invention further seeks to provide a lubricating oil composition which incorporates a boric acid modified aminoamide compound.

In accordance with one aspect of the invention, there is provided a method of preparing a boric acid modified aminoamide compound which comprises reacting, in the presence of a hydrocarbon solvent, an aminoamide compound with a boric acid of the group consisting of orthoboric acid, metaboric acid, tetraboric acid and mixtures thereof, the boric acid being added in an amount of 0.05–5.0 mol per mol of the aminoamide compound, the reaction being effected at the reflux temperature of the hydrocarbon solvent.

In accordance with another aspect of the invention, there is provided a lubricating oil additive chiefly comprising a boric acid modified aminoamide compound resulting from the reaction of an aminoamide compound with a boric acid.

In accordance with a further aspect of the invention, there is provided a lubricating oil composition comprising a mineral oil and/or a synthetic oil and a boric acid modified aminoamide compound resulting from the reaction of an aminoamide compound with a boric acid, the modified aminoamide compound being added in an amount of 1–30 percent by weight based on the total weight of the oil composition.

The above and other objects, features and advantages of the invention will become apparent from the following detailed description.

DETAILED DESCRIPTION OF THE INVENTION

The term aminoamide compound as used herein typically designates an acylated polyalkylenepolyamine.

Polyalkylenepolyamine is represented by the general formula $$H_2N(-R-NH)_n-H \qquad (I)$$

wherein R is an alkylene group of preferably 2–3 carbon atoms and n is an integer of from 2 to 11.

Specific examples of polyalkylenepolyamine include diethylenetriamine, triethylenetetramine, tetraethylenepentamine, pentaethylenehexamine, hexaethyleneheptamine, heptaethyleneoctamine, octaethylenenonamine, nonaethylenedecamine, decaethyleneundecamine, undecaethylenedodecamine, dipropylenetriamine, tripropylenetetramine, tetrapropylenepentamine, pentapropylenehexamine, hexapropyleneheptamine, heptapropyleneoctamine, octapropylenenonamine, nonapropylenedecamine, decapropyleneundecamine, undecapropylenedodecamine, di(trimethylene)triamine, tri(trimethylene)tetramine, tetra(trimethylene)pentamine, penta(triethylene)hexamine, hexa(trimethylene)heptamine, hepta(trimethylene)octamine, octa(trimethylene)nonamine, nona(trimethylene)decamine, deca(trimethylene)undecamine and undeca(trimethylene)dodecamine.

Polyalkylenepolyamine is subjected to acylation with an agent such as a fatty acid of 6–30 carbon atoms, preferably a saturated fatty acid of 12–30 carbon atoms, or fatty acid derivatives such as halides and anhydrides of such fatty acids. Specific examples include fatty acids and derivatives thereof having a straight chain or branched structure such as dodecanoic acid, tridecanoic acid tetradecanoic acid, pentadecanoic acid, hexadecanoic acid, heptadecanoic acid, octadecanoic acid, nonadecanoic acid, eicosenoic acid and mixtures thereof.

These acylating agents are used in an amount preferably of 0.1–1 mol per mol of polyalkylenepolyamine. Acylation reaction conditions such as temperature, time length, catalyst and solvent are optional as observed in normal acylation practice, depending upon the type of polyalkylenepolyamine and acylating agent used.

The aminoamide compound thus synthesized is represented by the general formula $$\begin{array}{c} X \\ | \\ H-N-[(-R-NH-)_l(-R-\overset{\overset{\displaystyle R'C=O}{|}}{N}-)_m]-H \end{array} \qquad (II)$$

where X is a hydrogen atom or acyl group; R' is a hydrocarbon group derived from a fatty acid; l and m is l+m=n (see Formula I); and [] denotes that the groups in ( ) are randomly copolymerized, noting that at least one acyl group is present in the molecule.

For further details of aminoamide compounds, reference is made to, for example, Japanese Patent Publication No. 39-3115.

The boric acid used herein for reaction with the aminoamide compounds includes orthoboric acid, metaboric acid, tetraboric acid, anhydrous boric acid and mixtures thereof, and is added in an amount of 0.05–5.0 mols, preferably 0.1–3.0 mols per mol of aminoamide compound.

There is no particular restriction imposed upon the manner and conditions for the reaction of the aminoamide compound with the boric acid. This reaction may be typically carried out in the following manner. The aminoamide compound and the boric acid are introduced into a suitable reactor in the presence of a hydrocarbon solvent having a boiling point above 60° C. such as benzene, toluene and xylene. Other eligible solvents are petroleum solvents such as benzine, ligroin, mineral spirit and cleaning solvent and mineral oil fractions such as naphtha, kerosine, gas oil and lubricant fraction. The admixture is then heated with stirring and refluxed at the solvent boiling point. Refluxing is continued for 1–5 hours, preferably 2–4 hours, followed by stopping the heat and subsequently by dehydration with sodium sulfide or magnesium sulfide. The solvent is then removed, followed if necessary by vacuum distillation or other refining treatment to obtain a desired aminoamide as modified with a boric acid.

The inventive boric acid modified aminoamide may be effectively used as an additive to a mineral oil and/or a synthetic base oil to produce a lubricating oil composition. There is no particular limitation to the base oil. This oil may be any oil known for use as a lubricating base oil. The mineral oil referred to herein may be paraffinic or naphthanic lubricating oil fractions derived from topping or vacuum distillation of a crude oil and treated by solvent-deasphalting, solvent-extraction, hydrogenative decomposition, solvent or catalytic dewaxing, hydrogenation, sulfur washing, clay and like refining processes. When the inventive lubricating oil is used for two stroke cycle engines, there may be used hydrocarbon solvents such as benzine, ligroin, mineral spirit, cleaning solvent, naphtha fractions, kerosene fractions, gas oil fractions, n-paraffin and iso-paraffin.

The synthetic oil referred to herein includes poly-α-olefin(polybutene, 1-octenoligomer, 1-decenoligomer), alkylbenzene, alkylnaphthalene, diester(ditridecylglutalate, di-2-ethylhexyladipate, diisodecyladipate, ditridecyladipate, di-2-ethylhexylsebacate), polyolesterer(trimethylolpropanecaprylate, trimethylolpropanepelargonaate, pentaerythritol-2-ethylhexanoate, pentaerythritolpelargonate), polyoxyalkyleneglycol, polyphenylether and perfluoroalkylether. These base oils may be used alone or in combination.

In preparing a lubricating oil composition by incorporating the inventive boric acid modified aminoamide compound into a mineral oil and/or a synthetic oil, the modified aminoamide compound is used in an amount of 1–30 weight percent, preferably 3–20 weight percent based on the total weight of the composition.

The lubricating oil composition provided by the invention finds extensive application ranging from gasoline engine oil (four stroke cycle and two stroke cycle), diesel engine oil, hydraulic oil, gear oil, to automatic transmission oil, and may be blended if desired with conventional additives such as metal cleaning agent, non-ash dispersant, extreme pressure additive, friction reducing agent, rust-proofing agent, corrosion inhibitor, defoaming agent, pour point reducing agent, viscosity index improver and oxidation inhibitor.

The invention will be further described by way of the following examples which are provided for purposes of illustration and should not be construed as limiting the invention thereto.

Preparation of Aminoamide Compound

A 1,000 ml round-bottom flask equipped with stirrer, reflux condenser, thermometer and nitrogen feed tube was charged with 0.1 mol (19 g) of tetraethylenepentamine, 200 ml of 10% sodium hydroxide solution and 300 ml of benzene and cooled to below 5° C. in an ice bath, followed by addition in droplets of 0.2 mol (60.5 g) of isooctadecanoic acid chloride over a period of one hour.

The admixture was then stirred at below 5° C. for one hour and thereafter re-heated and refluxed at the boiling point of benzene for a period of one hour. The reaction was discontinued. The reactor was let cooled and its contents were subjected to separation in a separating funnel. The upper separated layer of benzene was washed with 300 ml of deionized water repeatedly over five times. The reaction product was dehydrated with anhydrous sodium sulfide, followed by removal of benzene. There were obtained 68 g of light yellowish transparent viscous liquid. The resulting reaction product was analyzed to reveal 75.2 weight percent of carbon, 13.1 weight percent of hydrogen and 9.2 weight percent of nitrogen.

INVENTIVE EXAMPLE 1

50 g of aminoamide obtained as above were charged into a 500 ml reactor having a trap for the water formed between the flask and the reflux condenser and otherwise similar to the reactor used as above. 300 ml of toluene and 0.035 mol (2.15 g) of boric acid were added. Heating with stirring was initiated, followed by refluxing at the boiling point of toluene until about 0.5 ml of water was distilled out (over about three hours), when heating was discontinued. The reactor was let cooled and its contents were dehydrated with anhydrous sodium sulfide, and toluene was removed by distillation. The resulting reaction product was a liquid more viscous than the aminoamide compound.

INVENTIVE EXAMPLE 2

The procedure of Inventive Example 1 was followed except that the amount of boric acid added was 0.07 mol (4.3 g) and that heating was discontinued when about 1 ml of water distilled out. There were obtained 53 g of liquid product more viscous than the aminoamide compound. Analysis of the reaction product showed 74.8 wt % of carbon, 12.8 wt % of hydrogen, 9.1 wt % of nitrogen and 0.7 wt % of boric acid.

INVENTIVE EXAMPLE 3

The procedure of Inventive Example 1 was followed except that the amount of boric acid added was 0.14 mol (8.6 g) and that heating was discontinued when about 2 ml of water distilled out. The resulting liquid product was more viscous than the aminoamide compound.

INVENTIVE EXAMPLE 4

A 2,000 ml reactor similar to that which was used in Inventive Example 1 was charged with 1,000 g of aminoamide dispersant (tradenamed OLOA 340D of Chevron Research Company), 300 ml of xylene and 0.94 mol (58.3 g) of boric acid. Heating with stirring was initiated, followed by refluxing at the boiling point of xylene until about 7 ml of water distilled out (over about three hours), at which time point heating was discontinued. The reactor was let cooled and its contents were dehydrated with anhydrous sodium sulfide, and xylene was distilled off. The resulting reaction product was more viscous than the aminoamide compound.

Laboratory Evaluation Test

The reaction products, i.e. boric acid modified aminoamide compounds obtained in Inventive Examples 1–4 above, were each added to a base oil for two stroke cycle engine and tested for thermal stability (high temperature cleanliness) by a hot tube test (HTT), details of which test are disclosed in SAE Paper 887619 (1988).

The results of the HTT are known to be highly analogous to those of actual engine tests, and therefore the HTT is widely utilized as a screening test prior to engine testing.

The HTT test results are shown in Table 1 below, in which the degrees to which the test oil became deteriorated are represented by a numerical order where the higher the number, the better are the results. The numerical value of "10" denotes that there was no deposit or no lacquer-like color on the inner wall of a glass tube through which the oil was passed in heat and oxidation atmosphere. The "0" value is indicative of the glass wall being stained black.

TABLE 1

| | Inventive Example | | | | Comparative Example | | | |
|---|---|---|---|---|---|---|---|---|
| Test Oil | 5 | 6 | 7 | 8 | 1 | 2 | 3 | 4 |
| Additive | Inventive Example | | | | | | | |
| | 1 | 2 | 3 | 4 | *1 | *2 | *3 | *4 |
| HTT Rating Point (280° C., 16 hrs) 10 = best 0 = worst | 8 | 10 | 10 | 8 | 2 | 0 | 3 | 3 |

Note:
*1 is the aminoamide prepared as herein above.
*2 is a commercially available aminoamide dispersant.
*3 is a commercially available succinimide dispersant.
*4 is a commercially available boric acid modified succinimide dispersant.

The base oil used and the amount of 3.5 wt % of the inventive modified aminoamide compound added were the same throughout Inventive Examples 5–8. Comparative Examples 1–4 were conventional lubricating oil compositions each with additives other than the inventive additive.

HTT test was made for another set of lubricating oil compositions comprised of ester-based base oils for two stroke cycle engines incorporating the inventive boric acid modified aminoamide compound and comparatively for conventional counterparts, with the results shown in Table 2.

TABLE 2

| | Inventive Example | | | | Comparative Example | | | |
|---|---|---|---|---|---|---|---|---|
| Test Oil | 9 | 10 | 11 | 8 | 5 | 6 | 7 | 8 |
| Additive | Inventive Example | | | | | | | |
| | 1 | 2 | 3 | 4 | *1 | *2 | *3 | *4 |
| HTT Rating Point (16 hrs) | | | | | | | | |
| 240° C. | 10 | 10 | — | — | 10 | 10 | — | — |
| 260° C. | 10 | 10 | — | — | 10 | 10 | 7 | 8 |
| 270° C. | 10 | 10 | — | — | 0 | 0 | 5 | 6 |
| 280° C. | 10 | 10 | 10 | 10 | 0 | 0 | 3 | 5 |

Note:
*1 to *4 are same as Table 1.

Engine Test

This test was conducted with an air-cooled 249 cc engine of V-2 cylinder type mounted on a sports motorcycle running under speed-way conditions set forth in Table 3 below.

TABLE 3

| | |
|---|---|
| Engine Speed | 6000–7000–9000 rpm |
| Engine Load | 100% |
| One-Cycle | 10–5–45 min. |
| Test Time | 5 cycle (5 hrs) |
| Plug Gasket Temperature | 100–110° C. |
| Fuel: Oil Ratio | 30:1 (Injection) |

Engine test results are shown in Table 4, demonstrating that the inventive lubricating oil compositions provide improved piston cleanliness over the conventional counterparts, particularly in view of significantly reduced deposits on piston underhead or cylinder head.

TABLE 4

| Test Oil Additive | | Inventive Example 13 Inventive Example 4 | Inventive Example 14 Inventive Example 4 | Comparative Example 9 Comparative Example 2 |
|---|---|---|---|---|
| Amount of Additive | | 15 wt % | 10 wt % | 15 wt % |
| Piston Ring Sticking Deposits | top | 9.7 | 9.7 | 9.7 |
| | second | 10 | 10 | 10 |
| Piston Ring Land | top | 6.7 | 6.3 | 5.1 |
| | second | 10 | 9.9 | 9.3 |
| Piston Skirt | | 9.6 | 9.5 | 8.9 |
| Piston Undercrown | | 6.8 | 7.6 | 3.1 |
| Engine Cleanliness (total merit rating, 60 = best) | | 52.8 | 53.0 | 46.1 |

What is claimed is:

1. A lubricating oil composition comprising a mineral base oil, a synthetic base oil or a mixture thereof, and a modified aminoamide compound resulting from the reaction of an aminoamide compound with boric acid, said aminoamide compound being added in an amount of 1–30 percent by weight based on the total weight of said oil composition, wherein said aminoamide compound is represented by the formula

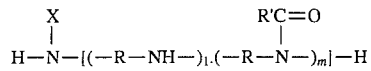

where X is a hydrogen atom or an acyl group derived from a fatty acid of 6–30 carbon atoms; R is an alkylene group of 2–3 carbon atoms; R'C=O is an acyl group derived from a fatty acid of 6–30 carbon atoms; l+m is an integer of from 2 to 11; and wherein said aminoamide compound has at least one acyl group.

2. A lubricating oil composition as claimed in claim 1; wherein said modified aminoamide compound is prepared by reacting the aminoamide compound with said boric acid in an amount of 0.05–5.0 mol per mol of said aminoamide compound in the presence of a hydrocarbon solvent at a reflux temperature of the solvent.

3. A lubricating oil composition as claimed in claim 2; wherein said boric acid is selected from the group consisting of orthoboric acid, metaboric acid, tetraboric acid and mixtures thereof.

4. A lubricating oil additive comprising a modified aminoamide compound resulting from the reaction of an aminoamide compound with boric acid, wherein said aminoamide compound is represented by the formula

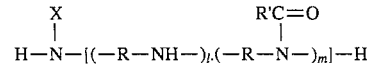

where X is a hydrogen atom or an acyl group derived from a fatty acid of 6–30 carbon atoms; R is an alkylene group of 2–3 carbon atoms; R'C=O is an acyl group derived from a fatty acid of 6–30 carbon atoms; l+m is an integer of from 2 to 11; and wherein said aminoamide compound has at least one acyl group.

5. A lubricating oil additive as claimed in claim 4; wherein said modified aminoamide compound is prepared by reacting the aminoamide compound with said boric acid in an amount of 0.05–5.0 mol per mol of said aminoamide compound in the presence of a hydrocarbon solvent at a reflux temperature of the solvent.

6. A lubricating oil additive as claimed in claim 5 wherein said boric acid is selected from the group consisting of orthoboric acid, metaboric acid, tetraboric acid and mixtures thereof.

7. A lubricating oil additive according to claim 4; wherein the acyl groups of said aminoamide compound are derived from monobasic fatty acids.

8. A lubricating oil additive as claimed in claim 4; wherein X is a hydrogen atom or an acyl group derived from a fatty acid of 12–30 carbon atoms and R'C=O is an acyl group derived from a fatty acid of 12–30 carbon atoms.

9. A lubricating oil additive as claimed in claim 4; wherein said aminoamide compound is prepared by reacting a polyalkyleneamine with a fatty acid of 12–30 carbon atoms, said polyalkyleneamine being represented by the formula $$H_2N(—R—NH)_n—H$$

where R is an alkylene group of 2–3 carbon atoms and n is an integer of from 2 to 11.

10. A lubricating oil additive as claimed in claim 9; wherein said polyalkyleneamine is tetraethylenepentamine and said fatty acid is isooctadecanoic acid.

* * * * *